US007195520B1

(12) United States Patent
Huang

(10) Patent No.: US 7,195,520 B1
(45) Date of Patent: Mar. 27, 2007

(54) CONNECTOR FOR ANTENNA

(76) Inventor: Chung-Chuan Huang, No. 31, Lane 57, Jhenhan 1st St., Yongkang City, Tainan, Yongkang (TW)

( * ) Notice: Subject to any disclaimer, the term of this patent is extended or adjusted under 35 U.S.C. 154(b) by 0 days.

(21) Appl. No.: 11/488,033

(22) Filed: Jul. 18, 2006

(51) Int. Cl.
*H01R 25/00* (2006.01)

(52) U.S. Cl. ..... 439/638; 439/332; 439/916

(58) Field of Classification Search ..... 439/638, 439/650–651, 332, 916, 903
See application file for complete search history.

(56) References Cited

U.S. PATENT DOCUMENTS 5,018,991 A * 5/1991 Katz et al. ..... 439/620.28
6,162,082 A * 12/2000 Karsten et al. ..... 439/318
6,733,336 B1 * 5/2004 Montena et al. ..... 439/578
2004/0072473 A1 * 4/2004 Wu ..... 439/638

* cited by examiner

*Primary Examiner*—J. F. Duverne
(74) *Attorney, Agent, or Firm*—Rosenberg, Klein & Lee

(57) ABSTRACT

A connector for antenna includes a hollow casing having a flange and an annular protrusion extending inward from an inner periphery thereof. A plurality of notches are defined through the annular protrusion. A terminal has a first end inserted into the first end of the casing and a stop ring is mounted on the terminal to seal the first end of the casing. A C-shaped spring member is mounted on the terminal and including a C-shaped body and two legs which are engaged with the notches of the annular protrusion. The C-shaped body is located between the flange and the annular protrusion. The spring member is well positioned so that it is not rotated when the antenna is rotated and no noise is generated.

4 Claims, 5 Drawing Sheets

CONNECTOR FOR ANTENNA

FIELD OF THE INVENTION

The present invention relates to a connector for antenna, wherein the connector is easily to be connected with the antenna and no noise when rotating the antenna.

BACKGROUND OF THE INVENTION

A conventional antenna used on cordless phone base or network router 10 is shown in FIGS. 1 to 3 and generally includes a plurality of reception ports 11 and each of which is cooperated with a threaded tube 12 which extends out from the body of the router 10 so that the antenna 20 can be threaded to the threaded tube 21 by a connector 30. The antenna 20 can be pivoted relative to the connector 30 so as to be oriented a proper direction to receive the signals. The connector 30 includes a terminal 31, a plastic plate 32, a spring member 33, two conductive rings 34, 35, a casing 36 and an isolation member 37. The front end 311 of the terminal 31 is inserted through the plastic plate 32, the spring member 33, the two conductive rings 34, 35 and is fixed to the casing 36. The terminal 31 contacts against the plastic plate 31 and the isolation member 37 is inserted into the casing 36 from the other end of the casing 36 and connected with the front end 311 of the terminal 31. The casing 36 is then rolled inward to be fixedly mounted on the antenna 20 to position the plastic plate 32 in the casing 36.

However, the spring member 33 is located between the plastic plate 32 and the conductive ring 34, so that the spring member 33 pushes the plastic plate 32 and the conductive ring 34 outward. When the antenna 20 is rotated, the spring member 33 is pushed and co-rotated with the antenna 20, noise is generated during the adjustment of the antenna 20. Besides, the spring member 33 is normally squeezed and might reach its limit of fatigue which causes the antenna to be loose. Furthermore, the case 36 has to be rolled inward and this requires a specific tool or machine which increases the manufacturing cost.

The present invention intends to provide a connector for antenna an the connector is easily assembled with the antenna and no noise is generated during rotation.

SUMMARY OF THE INVENTION

The present invention relates to a connector for antenna and the connector comprises a hollow casing having a flange and an annular protrusion respectively extending inward from an inner periphery thereof. The flange includes a first side facing a first end of the casing and a second side facing a second end of the casing. The annular protrusion is located between the first end of the casing and the flange. A plurality of notches are defined through the annular protrusion. A terminal has a first end inserted into the first end of the casing and an isolation member is received in the first end of the terminal. A C-shaped spring member is mounted on the terminal and includes a C-shaped body and two legs on two ends of the C-shaped body. The C-shaped body is located between the first side of the flange and the annular protrusion, and the two legs are engaged with the notches.

The primary object of the present invention is to provide a connector for antenna wherein a C-shaped spring member is received in the casing and two legs of the C-shaped spring member are engaged with two notches of an annular protrusion in the inner periphery of the casing so that the spring member is not co-rotated with the terminal. No extra rolling process is needed to be applied to the casing.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
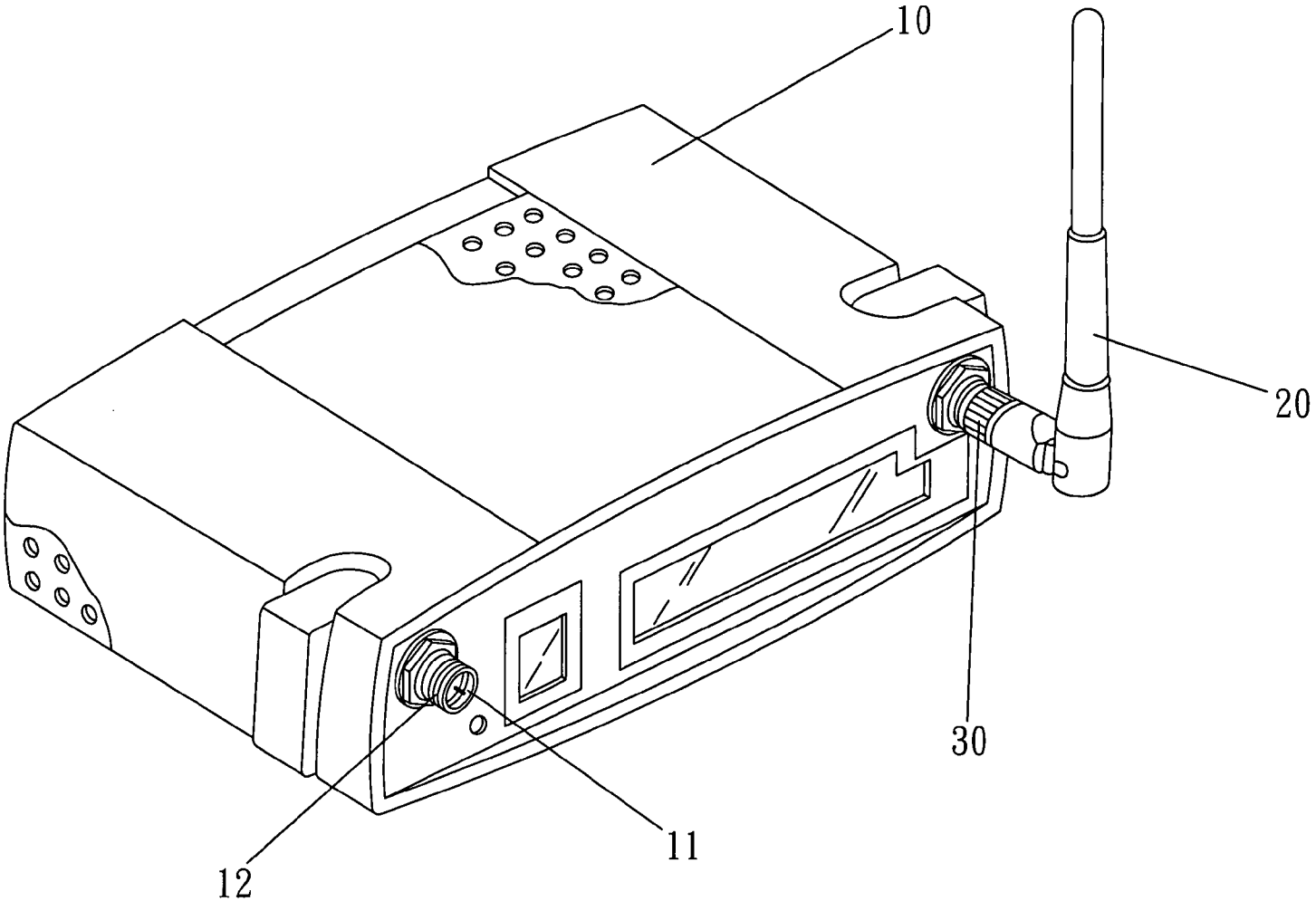
FIG 1 PRIOR ART
FIG. 1 shows a conventional connector and antenna is connected to a router.
Figure 2:
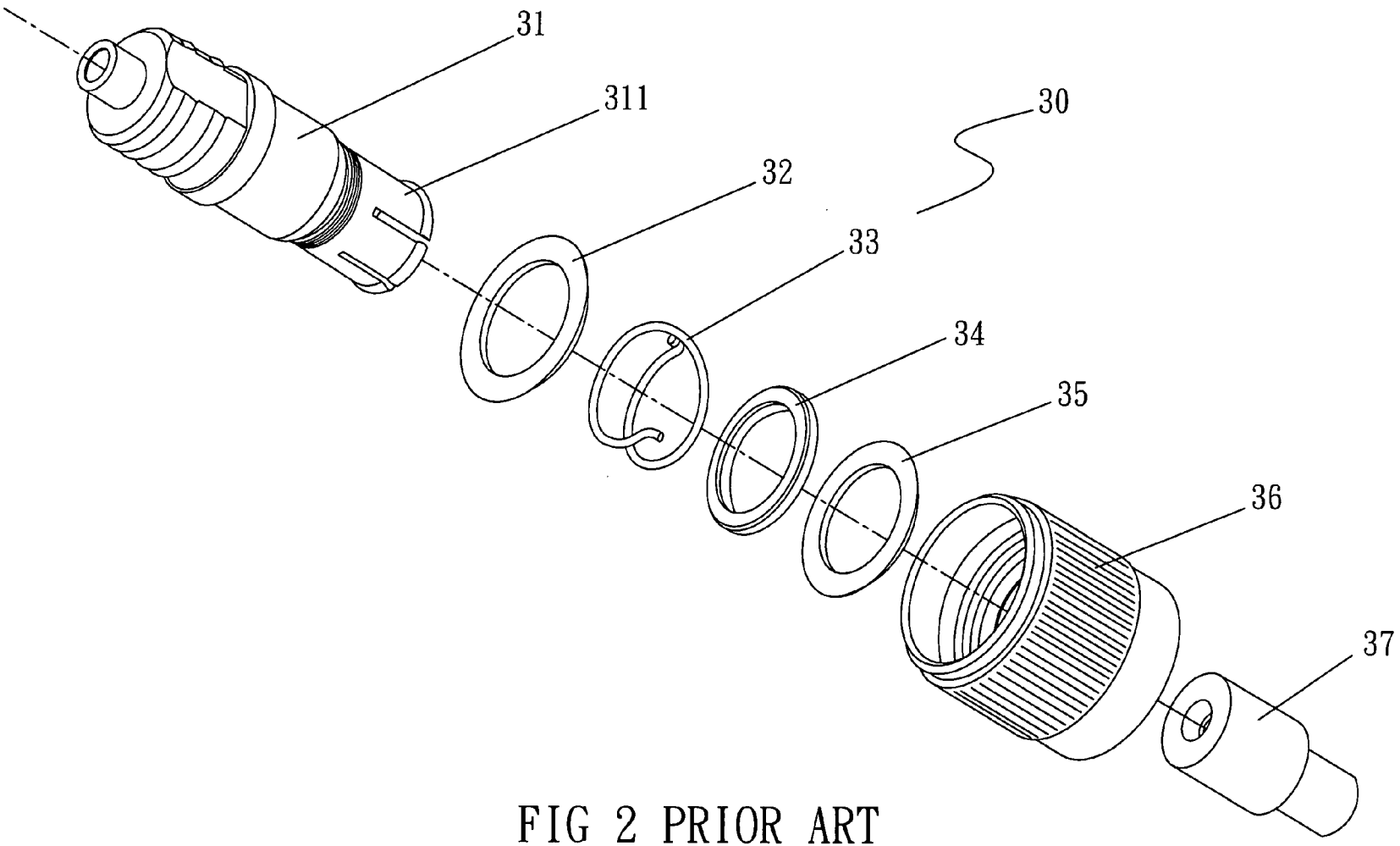
FIG 2 PRIOR ART
FIG. 2 is an exploded view to show the conventional connector.
Figure 3:
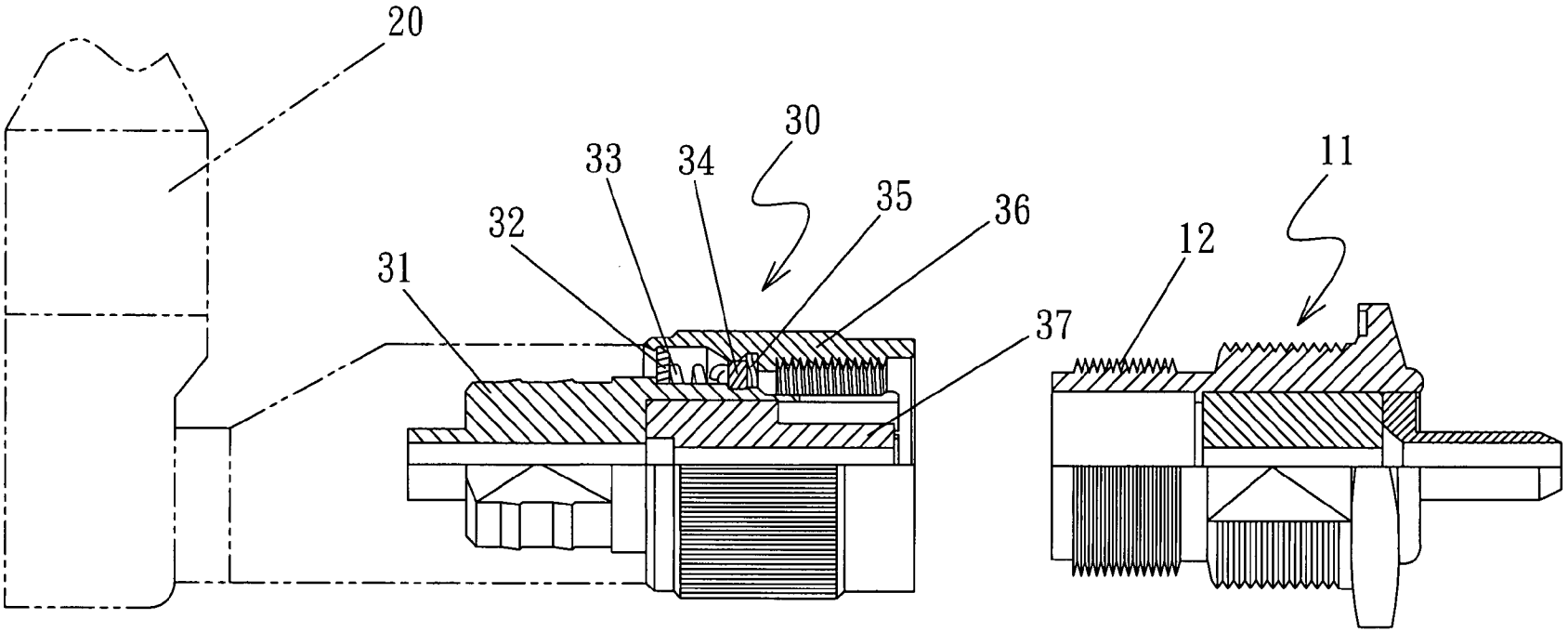
FIG 3 PRIOR ART
FIG. 3 is a cross sectional view to show that the terminal is to be inserted into the casing of the conventional connector.
Figure 4:
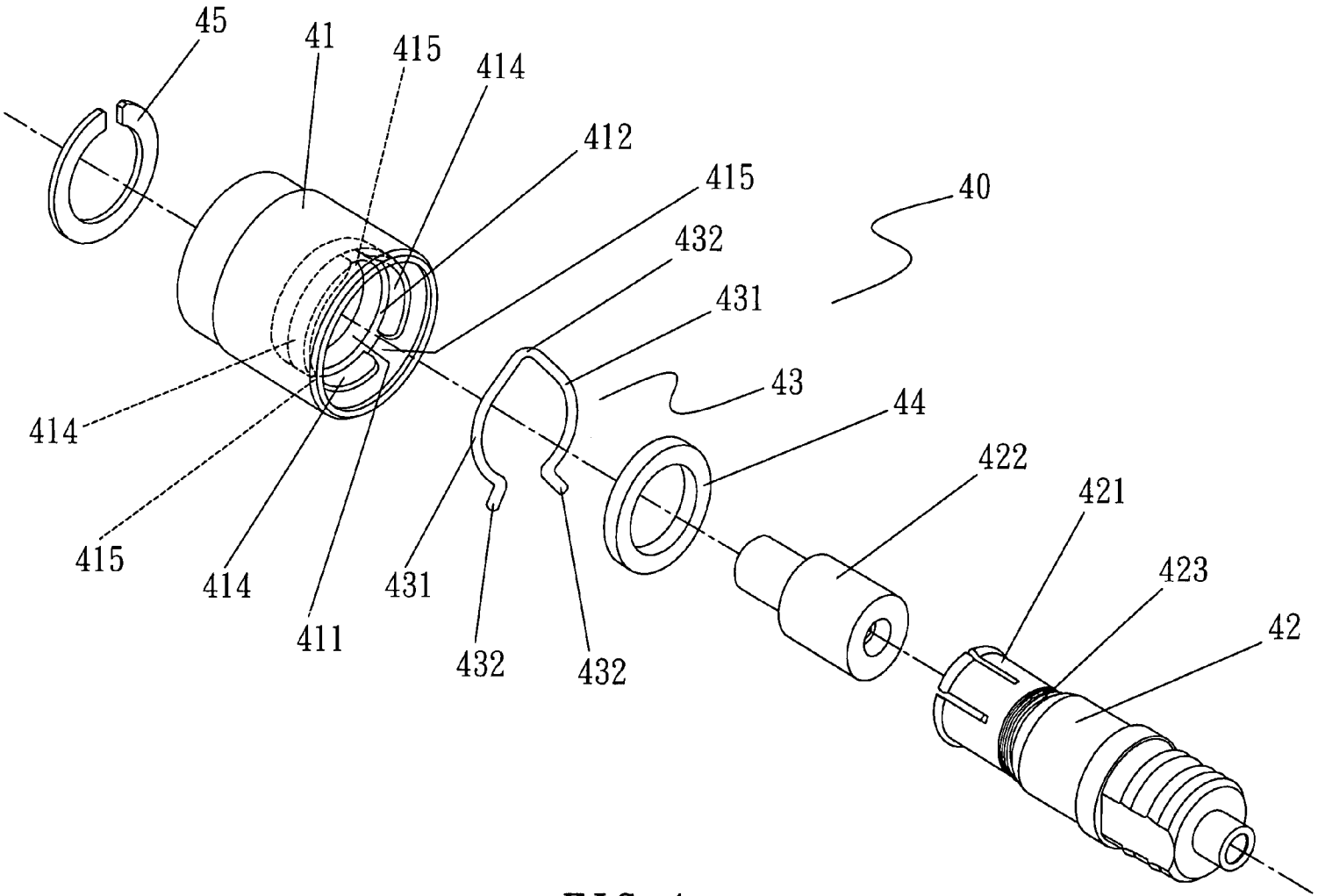
FIG. 4 is an exploded view to show the connector of the present invention.
Figure 5:
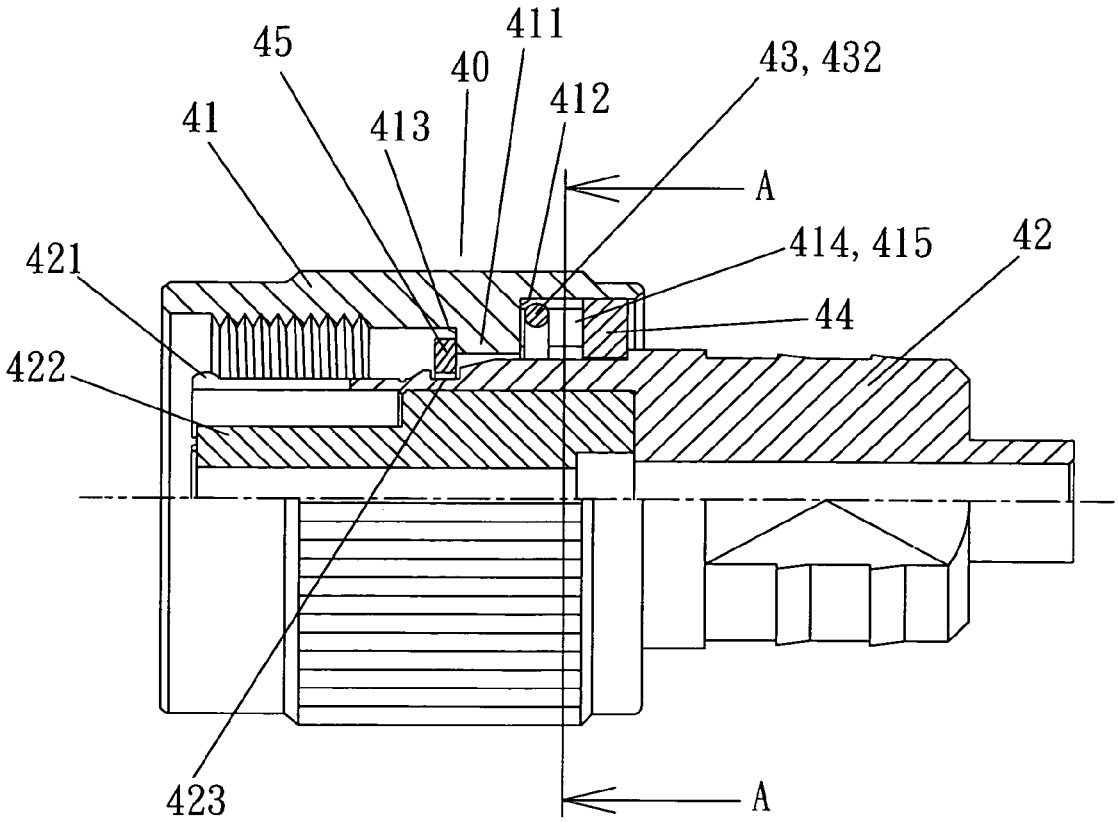
FIG. 5 is a side cross sectional view to show the combination of the connector and the terminal of the present invention.
Figure 6:
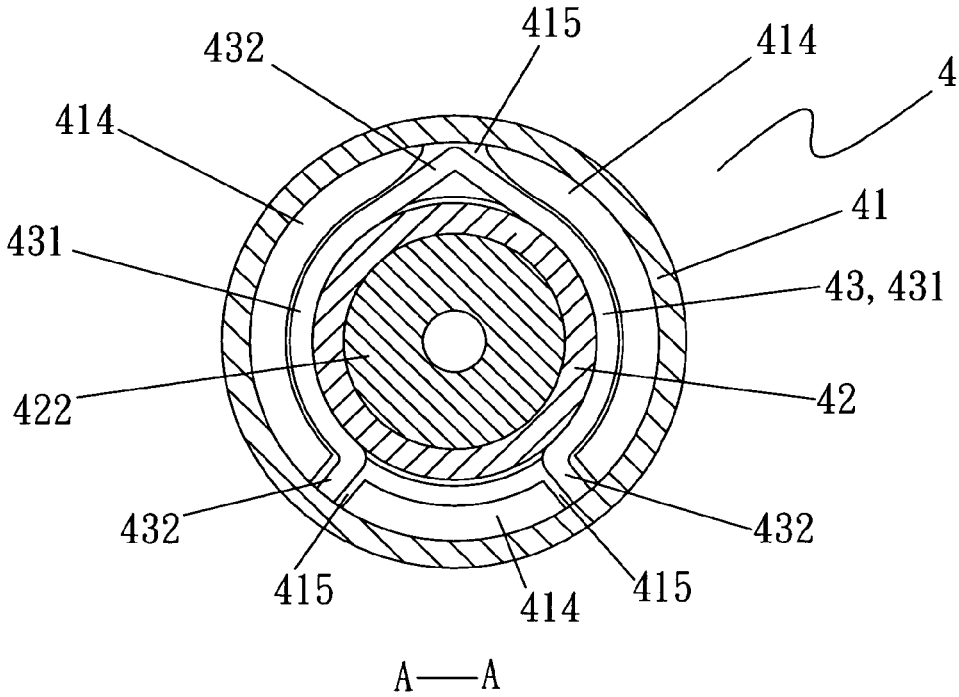
FIG. 6 is an end cross sectional view along the line A—A in FIG. 5 to show the combination of the connector and the terminal of the present invention.

Referring to FIGS. 4 to 6, the connector 40 of the present invention comprises a tubular and hollow casing 41 which has a flange 411 and an annular protrusion 414 extending inward from an inner periphery thereof at a distance. The flange 411 includes a first side 412 facing a first end of the casing 41 and a second side 413 facing a second end of the casing 41. The annular protrusion 414 is located between the first end of the casing 41 and the flange 411. A plurality of notches 415 are defined through the annular protrusion 414.

A terminal 42 has a first end 421 inserted into the first end of the casing 41 and an isolation member 422 is received in the first end 421 of the terminal 42. A C-shaped spring member 43 is mounted on the terminal 42 and includes a C-shaped body 431 and two legs 432 on two ends of the C-shaped body 431. The C-shaped body 431 is located between the first side 412 of the flange 411 and the annular protrusion 414. The C-shaped body 431 has a projection portion 432 which is engaged with one notch 415 of the annular protrusion 414 and the two legs 432 are engaged with two of the notches 415. By this specific arrangement, the spring member 43 is well positioned. The terminal 42 has a stop ring 44 mounted thereto which is located between the annular protrusion 414 and the first end of the casing 41 so as to seal the first end of the casing 41 together with the terminal 42. After the first end 421 is inserted into the casing 41 and a groove 423 defined in an outer periphery of the terminal 42 is located between the second end of the casing 41 and the flange 411, a collar 45 is engaged with the groove 423 and in contact with the second side 413 of the flange 411.

The spring member 43 does not rotated with the rotation of the terminal 42 when the user adjusts the antenna so that no noise is generated by friction related to the spring member 43. Besides, the terminal 42 is positioned by the collar 45 so that no rolling process is needed to be applied to the casing 41. The number of the spring member 43 can be more than one when needed and the spring member 43 use less material so as to reduce the manufacturing cost.

While we have shown and described the embodiment in accordance with the present invention, it should be clear to those skilled in the art that further embodiments may be made without departing from the scope of the present invention.

What is claimed is:

1. A connector for antenna, comprising:

a hollow casing having a flange extending inward from an inner periphery thereof, the flange including a first side facing a first end of the casing and a second side facing a second end of the casing, an annular protrusion extending from the inner periphery of the casing and located between the first end of the casing and the flange, a plurality of notches defined through the annular protrusion, and a terminal having a first end inserted into the first end of the casing and an isolation member received in the first end of the terminal, a C-shaped spring member mounted on the terminal and including a C-shaped body and two legs on two ends of the C-shaped body, the C-shaped body located between the first side of the flange and the annular protrusion, the two legs engaged with the notches.

2. The connector as claimed in claim 1, wherein the terminal has a stop ring mounted thereto which is located between the annular protrusion and the first end of the casing so as to seal the first end of the casing together with the terminal.

3. The connector as claimed in claim 1, wherein the terminal has a groove defined in an outer periphery thereof and a collar is engaged with the groove, the collar is in contact with the second side of the flange.

4. The connector as claimed in claim 1, wherein the C-shaped body has a projection portion which is engaged with another notch of the annular protrusion.

* * * * *